US005429024A

United States Patent [19]

Shimizu

[11] Patent Number: 5,429,024

[45] Date of Patent: Jul. 4, 1995

[54] CARD CUTTING MACHINE

[75] Inventor: Tsuneo Shimizu, Tokyo, Japan

[73] Assignee: Taiho Industries, Ltd., Tokyo, Japan

[21] Appl. No.: 106,652

[22] Filed: Aug. 16, 1993

[51] Int. Cl.[6] ..... B26D 5/38

[52] U.S. Cl. ..... 83/209; 83/211; 83/268; 83/367; 83/371

[58] Field of Search ..... 83/371, 370, 367, 63, 83/209, 210, 211, 212, 268

[56] References Cited

U.S. PATENT DOCUMENTS

| | | | |
|---|---|---|---|
| 3,580,121 | 3/1971 | Asada | 83/371 |
| 3,646,789 | 3/1972 | Forster | 83/371 |
| 4,011,779 | 3/1977 | Berg | 83/212 |
| 4,255,994 | 3/1981 | Strunc | 83/371 |
| 4,781,090 | 11/1988 | Feldkemper et al. | 83/371 |
| 5,293,796 | 3/1994 | Zober | 83/371 |

*Primary Examiner*—Kenneth E. Peterson
*Attorney, Agent, or Firm*—Banner, Birch, McKie & Beckett

[57] ABSTRACT

A card cutting machine is disclosed herein, which includes a feeder and a cutting unit. A sheet with a mark affixed to an end thereof is conveyed from the feeder to the cutting unit, where it is cut into a desired card size. The machine further includes a mark reading device mounted in a sheet passage between the feeder and the cutting unit for detecting the mark affixed on the sheet, whereby only desired sheets are passed through the cutting unit.

4 Claims, 5 Drawing Sheets

CARD CUTTING MACHINE

BACKGROUND OF THE INVENTION

1. Field of the Invention

The present invention generally relates to a cutting machine for fabricating various cards such as membership cards, cards for medical examination in hospitals or the like, name cards and the like, and particularly, to a card cutting machine for cutting a file (sheet) of cards having characters or a document printed on a piece of sheet into a desired card size by a bench document printer or the like to separate cards one by one. More particularly, the present invention relates to a card cutting machine designed not only to be able to cut a file of cards safely, expeditiously and with a high accuracy even by an unskilled operator, but also to be able to selectively cut only desired sheets.

2. Description of the Prior Art

Card cutting techniques conventionally employed are three following methods:

(1) A method which comprises cutting a file of cards by a guillotine-type cutting machine to finish cards.

(2) A method which comprises punching a file of cards by a trimming die in a press to finish cards.

(3) A method which comprises cutting a sheet vertically and transversely one time, respectively, by a rotary cutter to finish cards.

However, any of the above methods (1), (2) and (3) is accompanied by following disadvantages (a), (b) and (c):

(a) A large-scaled and expensive mechanical equipment is required.

(b) A great deal of skill is required by an operator.

(c) A danger causing an injury or the like is involved.

These methods are absolutely unsuitable, for example, for a printing carried out at one corner or the like in a firm by an unskilled operator.

On the other hand, the service durability of a cutter mounted in many cutting machines is largely governed by the quality of a paper sheet to be cut and for this reason, it is necessary for maintaining the machine to select sheets useful for the cutter as exclusive sheets and to eliminate injurious sheets. However, there is hitherto no cutting machine having a capability of selecting sheets.

SUMMARY OF THE INVENTION

It is an object of the present invention to provide a card cutting machine in which the disadvantages associated with the above prior art techniques are overcome, and which is capable of not only cutting a sheet safely, expeditiously and with a high accuracy even by an unskilled operator, but also selectively cutting only desired sheets.

To achieve the above object, according to the present invention, there is provided a card cutting machine comprising a feeder and a cutting unit, so that a sheet with a mark affixed to an end thereof is conveyed from the feeder to the cutting unit, where it is cut into a desired card size, wherein the machine further includes a mark reading device mounted in a sheet passage between the feeder and the cutting unit for detecting the mark affixed on the sheet, whereby only desired sheets are passed through the cutting unit.

With the above construction, in cutting the sheet into various cards such as membership cards, cards for medical examination in hospitals or the like, name cards and the like, it is possible not only to cut the sheet safely, expeditiously and with a high accuracy, particularly even by an unskilled operator, but also to selectively cut only desired sheets.

Further, the provision of a sheet holer makes it possible to prevent margin at a rear end of the cut sheet from being scattered around, and to provide an improved dimensional accuracy of cutting.

The above and other objects, features and advantages of the invention will become apparent from a consideration of the following description of the preferred embodiments, taken in conjunction with the accompanying drawings.

DESCRIPTION OF THE PREFERRED EMBODIMENTS

The present invention will now be described by way of preferred embodiments in connection with the accompanying drawings.

Figure 1:
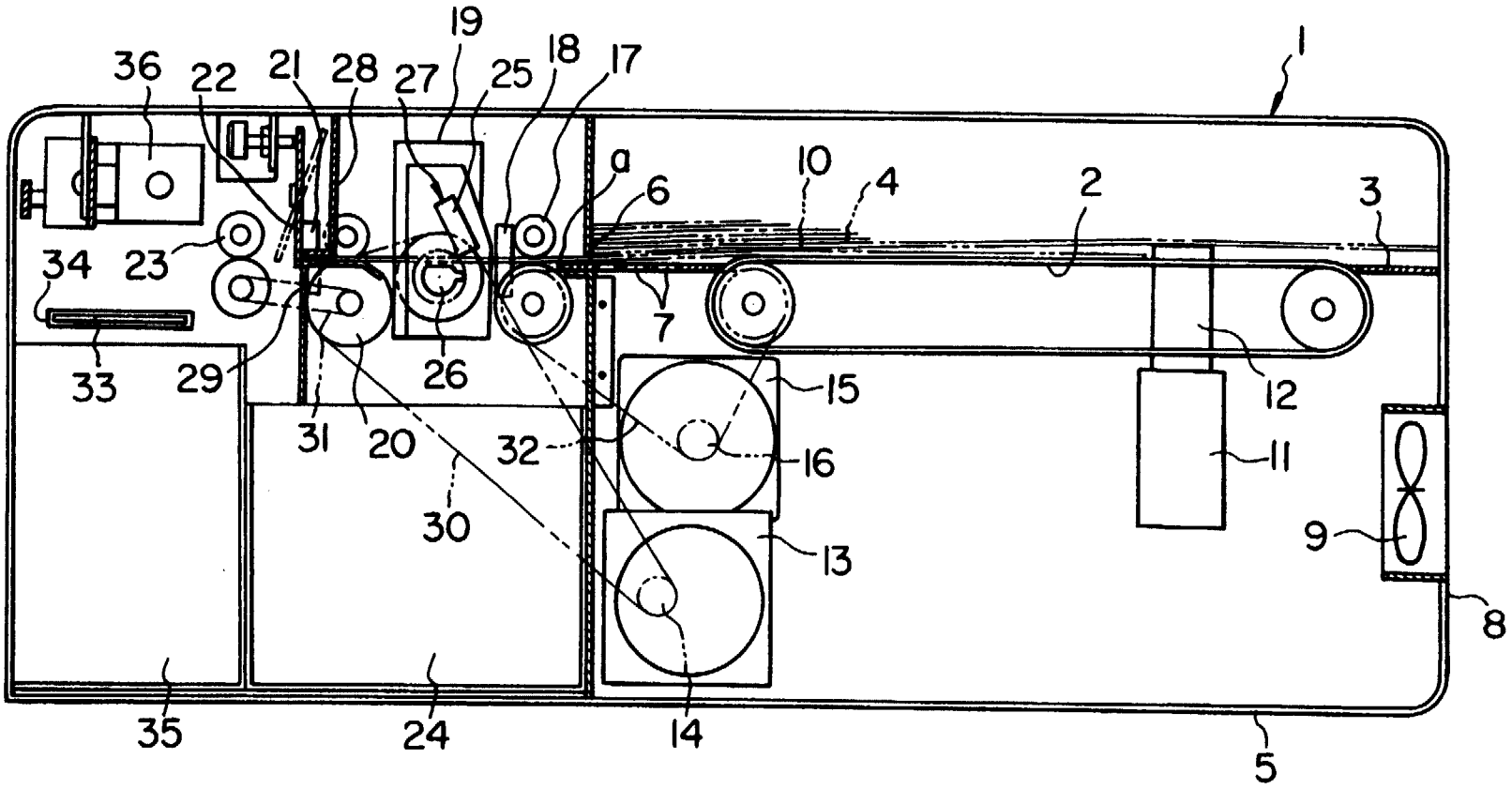
FIG. 1 is a sectional view of an embodiment of a card cutting machine according to the present invention.
Figure 2:
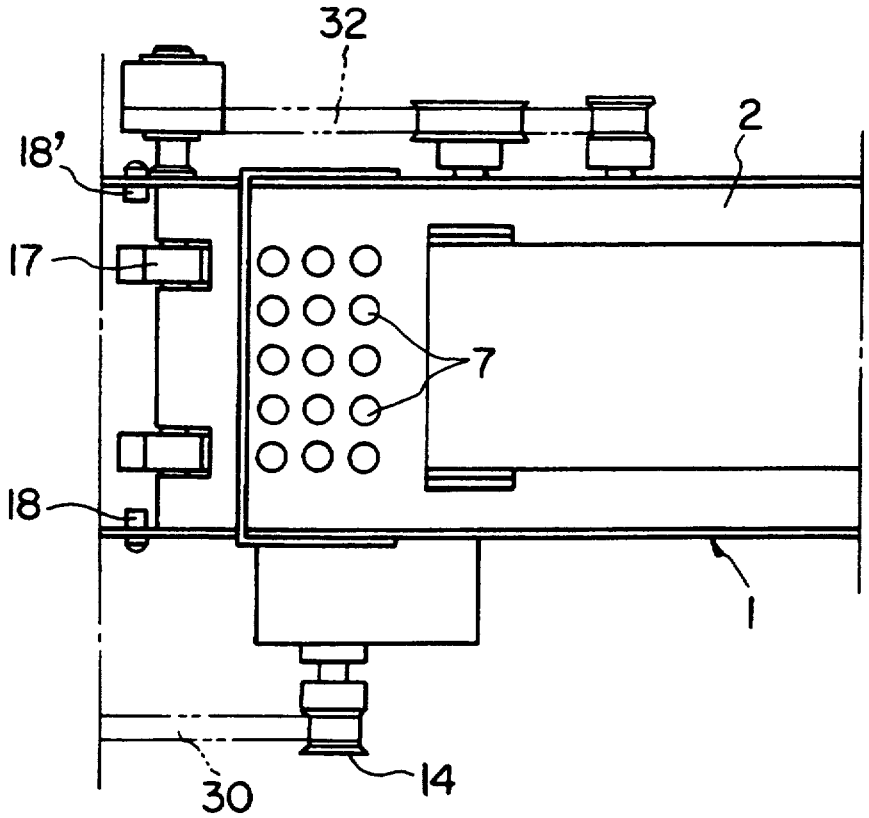
FIG. 2 is a plan view of a portion of the machine shown in FIG. 1.

Referring first to FIG. 1, an embodiment of a card cutting machine according to the present invention is illustrated. This card cutting machine includes a sheet feeder 1, as shown in FIGS. 1 and 2. The feeder 1 has a sheet rest 3 which includes a belt conveyer 2 as a sheet conveying mechanism. A pile of sheets 4 are placed on the sheet rest 3 astride the belt conveyer 2. Alternatively, a plurality of rotary rollers (not shown) may be arranged as the sheet conveying mechanism, in place of the belt conveyer 2.

The pile of paper sheets may comprise a stack of sheets of paper, plastic of the like with a desired mark affixed to an end thereof, and each of the sheets may be a card file comprising a plurality of cards having characters or a document printed on a piece of sheet by a bench document printer or the like.

Further, a box-like chamber 5 is defined below the sheet rest 3 of the feeder 1, and the sheet rest 3 serves as a ceiling of the box-like chamber 5. A plurality of bores 7,7—are made in the sheet rest 3 in the vicinity of a sheet discharge port 6, and an air-evacuating fan 9 is mounted in any place of the box-like chamber 5, e.g., on a sidewall of the box-like chamber 5, as shown in FIG. 1. When the air-evacuating fan 9 is operated, air is evacuated from the box-like chamber 5 to produce vacuum within the box-like chamber 5, thereby causing a lowermost sheet 10 of the sheet pile 4 to be brought into close contact with the sheet rest 3 at places corresponding to the bores 7, 7—, so that the lowermost sheet 10 can be easily discharged through the discharge port 6. Reference numeral 11 is a hip-up solenoid which will be described hereinafter and which is disposed in the box-like chamber 5. Reference numeral 12 is an push-up rod actuated by the operation of the hip-up solenoid 11 for pushing-up the sheet pile 4 in a manner which will be described hereinafter. Further, reference numeral 13 is a motor having a motor shaft 14, and reference numeral 15 is a stepping motor having a motor shaft 16. Both the motors 13 and 15 ate disposed within the box-like chamber 5 and will be described hereinafter.

Disposed in a passage a for the sheet 10 conveyed from the sheet discharge port 6 of the feeder 1 in sequence from the discharge port 6 are a first conveying roller means 17 comprised of a pair of upper and lower rollers, a mark reading device 18, a cutting unit 19, a second conveying roller means 20 comprised of a pair of upper and lower rollers, a gage sensor 21, a stopper 22 and a sheet discharge roller means 23 comprised of a pair of upper and lower rollers.

The mark reading device 18 is mounted in the passage a for the sheet 10 between the feeder 1 and the cutting unit 19, e.g., in a corner just beside the first conveying roller means 17, as clearly shown in FIG. 1 and particularly in FIG. 2, but may be disposed in an opposite corner (at a location indicated by a reference numeral 18').

Specifically, the mark reading device of such type may be a sensor and adapted to detect a mark affixed to an end of the sheet 10, as described hereinafter, thereby permitting only desired suitable sheets to be passed to the cutting unit 19.

Further, the mark reading device 18 detects a mark on the sheet 10 conveyed from the first conveying roller means 17 to deliver a signal indicative of a command to actuate the cutting unit 19 to cut the margin on the sheet 10. The resulting chips are dropped into a chip receiving box 24.

The cutting unit 19 includes a rotary cutter 27 comprising a combination of a stationary blade 25 and a rotary blade 26, so that the rotary edge 26 is rotated to be mated with the stationary blade 25, thereby cutting the sheet 10.

The gage sensor 21 is also called a second sensor and disposed in the passage a, as shown in FIG. 1, and in this case, in the passage a for the sheet 10 conveyed through the cutting unit 19 and the second conveying roller means 20. The gage sensor 21 is adapted to successively detect the tip end of each of said cards in the sheet 10 to deliver a signal indicative of a command to actuate the cutting unit 19. Reference numerals 28 and 29 are a pair of upper and lower guide plates.

The stopper 22 is disposed in the passage a and in this case, in the passage a for the sheet 10 conveyed through the gage sensor 21 to block the passage a, as shown in FIG. 1. In order to cut the sheet 10 into a desired size, e.g., a size (about 55 mm) corresponding to the width of a name card, the tip end of the sheet 10 is allowed to abut against the stopper 22, so that the conveying of the sheet 10 is temporarily stopped. It should be noted that the cutting unit 19 and the second conveying roller means 20 are operatively connected to the motor shaft 14 of the motor 13 through the belt 30 for operation in association with the motor shaft 14. The sheet discharging roller means 23 is operatively connected to the second conveying roller means 20 through the belt 31. Further, the belt conveyer 2 and the first conveying roller means 17 is operatively connected to the motor shaft 16 of the stepping motor 15 through the belt 32 for operation in association with the motor shaft 16.

The cut sheet (card) discharged from the sheet discharging roller means 23 is received on receiving platforms 33 which is disposed in the vicinity of the stopper 22 and below the sheet discharging roller 23. The receiving platforms 33 may be tip pieces of a pair of opposed L-shaped members and is projectingly mounted inside a main body by passing it laterally through an elongated hole 34 from the outside of the main body. A desired number of cut cards from the sheet discharging roller means 23 are stacked one on another astride the pair of receiving platforms 33, 33. If the pair of L-shaped members are then opened, the stacked cards are dropped into the card receiving box and accommodated therein. Reference numeral 36 is a sheet discharging solenoid.

The operation of the card cutting machine according to the present invention will be described below.

First, the motor 13 is driven to rotate a pulley of the cutting unit 19, the second conveying roller means 20 and the sheet discharging roller means 23 and further to operate the air-evacuating fan 9. Then, the stepping motor 15 is driven to rotate the belt conveyer 2 and the first conveying roller means 17. Thus, the lowermost sheet 10 of the sheet pile 4 accommodated in the feeder 1 by the rotation of the belt conveyer 2 is brought into close contact with the sheet rest 3 and conveyed through the sheet discharge port 6 and the first conveying roller means 17. When the sheet 10 reaches the reading device (i.e., sensor) 18, the latter detects the mark affixed to the end of the sheet 10.

Figure 3:
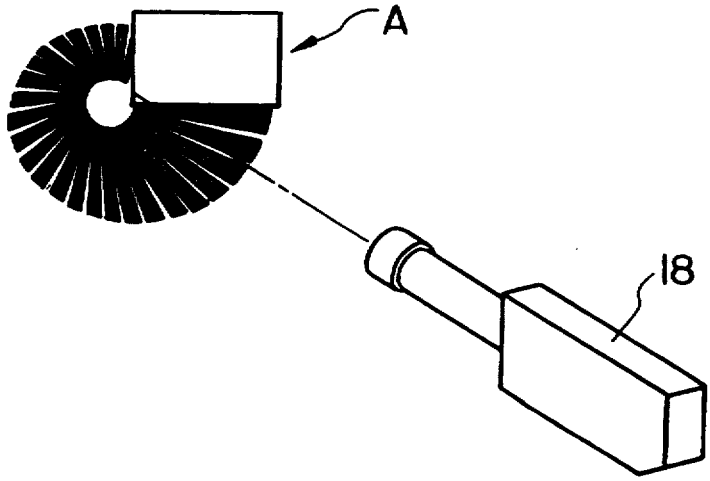
FIG. 3 is a diagrammatic view illustrating a sensor in a state in which it detects a mark.

FIG. 3 is a diagrammatic view illustrating the sensor in its state in which it detects the mark. Referring to FIG. 3, the sensor 18 first takes up the mark A and then performs an image processing to compare a read image with a reference pattern previously stored in the sensor 18, thereby judging whether or not the read image is conformed to the reference pattern. As a result, if the mark A affixed to the end of the sheet 10 is an appropriate mark, the sheet 10 is passed toward the cutting unit 19. On the other hand, if the mark A is an inappropriate mark, the conveying of the sheet is stopped.

When the sensor 18 has detected the mark A, the belt conveyer 2 conveys the sheet 10 through a distance of 18.5 mm (this distance can be freely adjusted) and is then stopped. The first conveying roller means is also operated and stopped simultaneously with the operation of the belt conveyer 2. Then, the solenoid of the cutting unit 19 is activated to rotate the rotary blade 26 in one rotation, thereby cutting off the margin of the sheet at a location rearwardly spaced apart by 2 mm (in the case of a standard setting) from the mark A. Cut chips are dropped into the receiving box 24 located below the cutting unit 19.

When the leading end of the sheet 10 has been passed through the cutting unit 19 and the second conveying roller means 20 to reach the gage sensor 21, this leading end is detected by the gage sensor 21. As a result, the hip-up solenoid 11 is first activated to operate the push-up rod 12, thereby pushing the sheet pile 4 on the belt conveyer 2 upwardly. At this time, the trailing end of the sheet 10 has been passed through the push-up rod 12 and hence, a clearance is produced between the sheet 10 and the sheet pile 4, thereby preventing a friction from being produced therebetween. When the leading end of the sheet 10 has reached just in front of the second conveying roller 20, i.e., when the stepping motor 15 has been rotated in 100 pulses after cutting of the margin, the gage solenoid is activated to previously close the stopper 22.

When the leading end of the sheet 10 with its margin cut off presently abuts against the stopper 22, the conveying of the sheet 10 is stopped, and a resistance is developed in the second conveying roller means 20, thereby causing the operation of a slide clutch mounted on a roller shaft of the second conveying roller means 20 to stop the rotation of the second conveying roller means 20.

Further, when the gage sensor 21 has detected the leading end of the sheet, the stepping motor 15 is stopped. After the sheet 10 has entered the second conveying roller means 20, the latter pulls the sheet 10. Thus, after the stepping motor has been stopped, the first conveying roller means 17 is rotated by the sheet pulled by the second conveying roller means 20 through a one-way clutch. The gage sensor 21 detects the leading end of the sheet 10 (after a lapse of 20 seconds from the detection, the leading end of the sheet abuts against the gage). The solenoid 19 of the cutting unit 19 is activated to rotate the rotary blade in one rotation, thereby cutting the sheet into a size of 55 mm. The sheet 10 is carried, on its opposite surfaces, by the guide plates 28 and 29 to abut against the stopper 22, whereby it is stopped.

When the cutting has been completed, the gage solenoid is turned OFF, causing the stopper 22 to be opened. When the stopper 22 has been opened, the resistance applied to the second conveying roller means 20 is eliminated, causing the second conveying roller means 20 to restart its rotation, thereby feeding the cut card forwardly. Then, the card reaches the sheet discharging roller means 23, by which the card is discharged onto the receiving platforms 33 above the receiving box 35.

When the last but one card file has been detected by the gage sensor, the hip-up solenoid is turned OFF, and the sheet pile 4 is brought again into contact with the belt conveyer 2. The cutting of the sheet is repeated in the same manner, whereby the rear end margin of the last sheet is cut off, and the cut-off margin is dropped into the chip-receiving box 24.

When the number of cards accumulated on the receiving platforms 33 reaches 50, the sheet discharging solenoid 36 is activated to drop these cards collectively into the card receiving box 35 located below the receiving platforms 33. If the cards are dropped collectively, the turning-over which may occur when the sheets are dropped one by one is prevented. When the processing of the first sheet 10 has been completed, the succeeding sheets, i.e., the second, third,—and last sheets are cut sequentially in the same manner.

If a pause mark on the sheet 10 is detected by a third sensor, the rear end margin of the last card file of the sheet 10 is not cut, and the processing of the next sheet can be continued.

In addition to the construction of the above-described embodiment of the present invention, a sheet holder can be provided, and if so, it is possible to prevent the rear end margin of the cut sheet from being scattered around, and to provide an improved dimensional accuracy of cutting.

Figure 4:
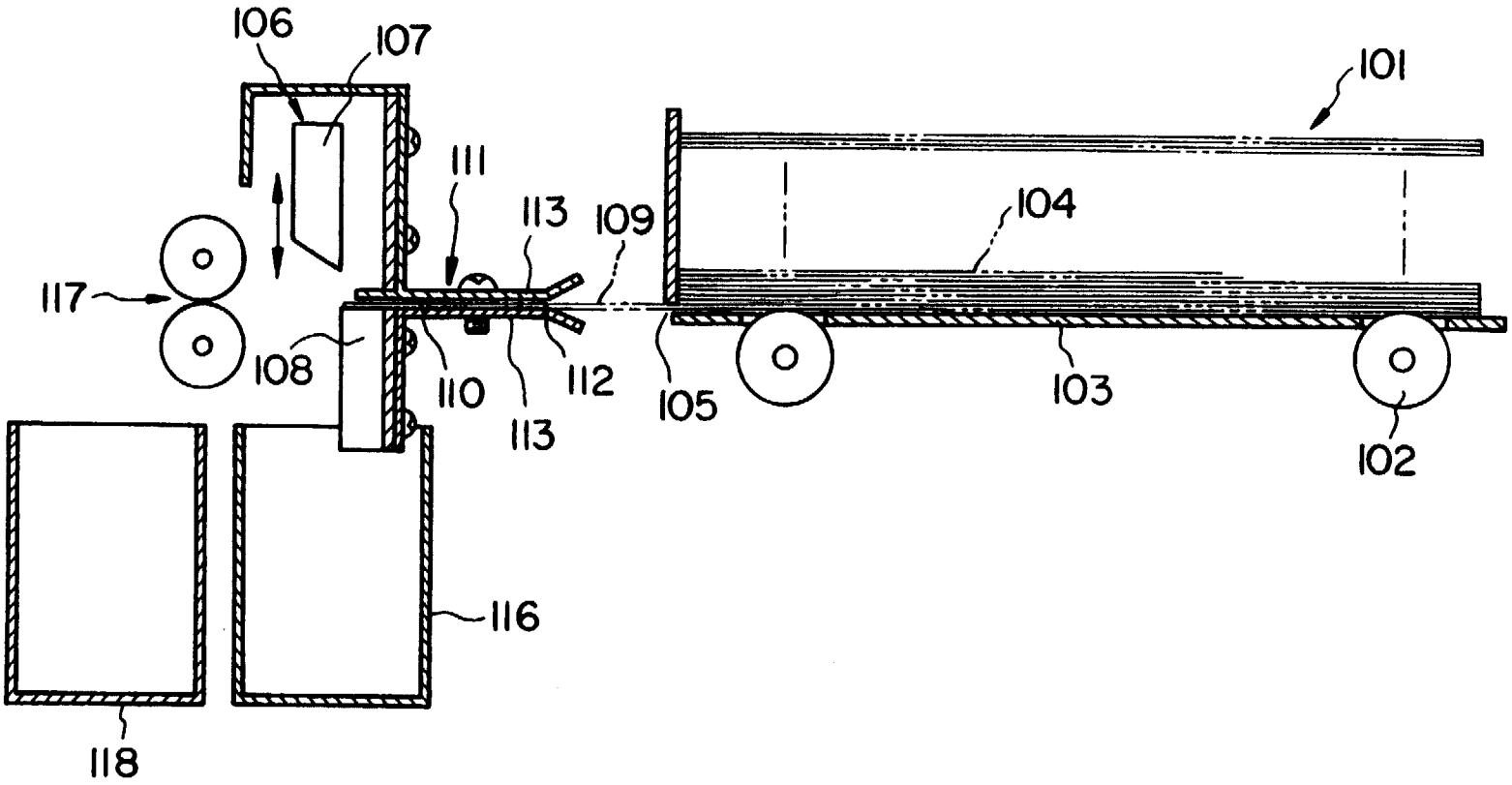
FIG. 4 is a sectional view of an alternative embodiment of a card cutting machine according to the present invention, which includes a sheet holder.

Referring to FIG. 4, an alternative embodiment of a card cutting machine according to the present invention is illustrated in a sectional view, which includes a sheet holder.

As shown in FIG. 4, the card cutting machine comprises a feeder 101 which includes a sheet rest 103 having rotary rollers 102 mounted in parallel thereon as a sheet conveying mechanism. A pile of sheets 104 is placed on the sheet rest 103 astride the rotary rollers 102. Alternatively, a belt conveyer which is not shown may be used, in place of the rotary rollers 102.

The sheet pile 104 may comprise a stack of sheets of paper, plastic or the like, and each of the sheets may be a card file comprising a plurality of cards having characters or a document printed on a piece of sheet by a bench document printer or the like.

A cutting unit 106 has a pair of upper and lower blades 107 and 108 and adapted to cut a sheet 109 conveyed from the feeder 101 into a desired card size.

The machine shown in FIG. 4 includes a sheet holder 111 mounted in the vicinity of the sheet inlet port 110 in the cutting unit 106.

The sheet holder 111 is comprised of a pair of upper and lower attachments 113, 113 disposed to guide the sheet 109 conveyed into the cutting unit 106 from its opposite sides and to leave a clearance 112 therebetween slightly wider than the width of the sheet 109.

Figure 5:
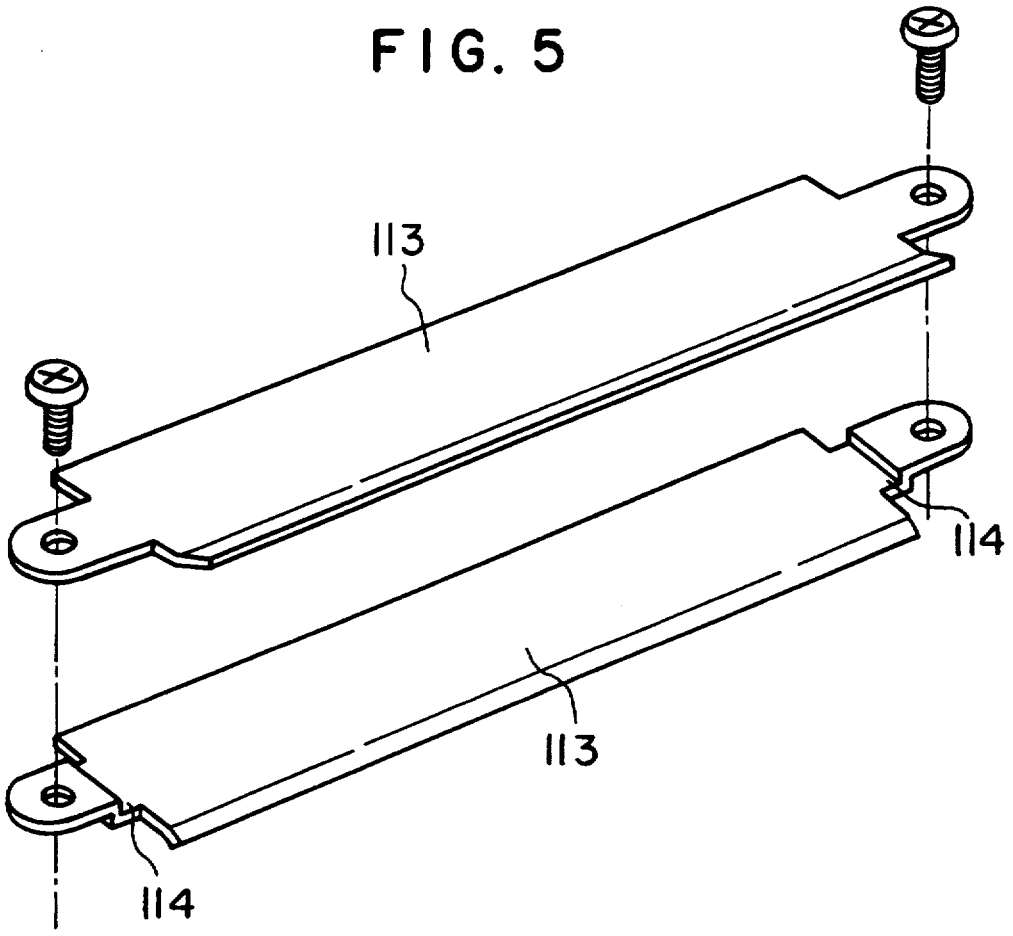
FIG. 5 is an exploded perspective view of the sheet holder used in the card cutting machine shown in FIG. 4.

The clearance 112 may be specifically in a range of 0.2 to 0.25 mm and is defined by a step 114 provided in the lower attachment 113, as shown in FIG. 5.

Figure 6A:
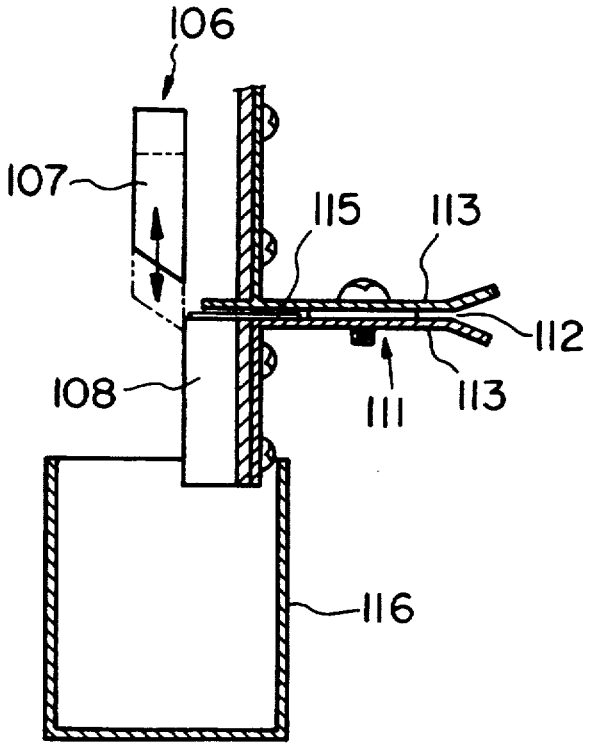
FIG. 6*a* is a sectional view of the card cutting machine with a margin held in a clearance.

In the machine constructed in the above manner, the margin 115 finally remaining at the rear end after the sheets have been cut one by one by the cutting unit 106 as shown in FIG. 6*a* are held in the clearance 112 defined between the attachments 113, 113, so that they cannot be scattered around, and thus, a so-called "rampage" phenomenon can be inhibited.

In addition, the margin 115 is held in the clearance 112 during cutting and hence, even if the width of the margin is small, the margin 115 is not brought into a free state, thereby achieving a satisfactory cutting and providing an improved dimensional accuracy for the card.

Figure 6B:
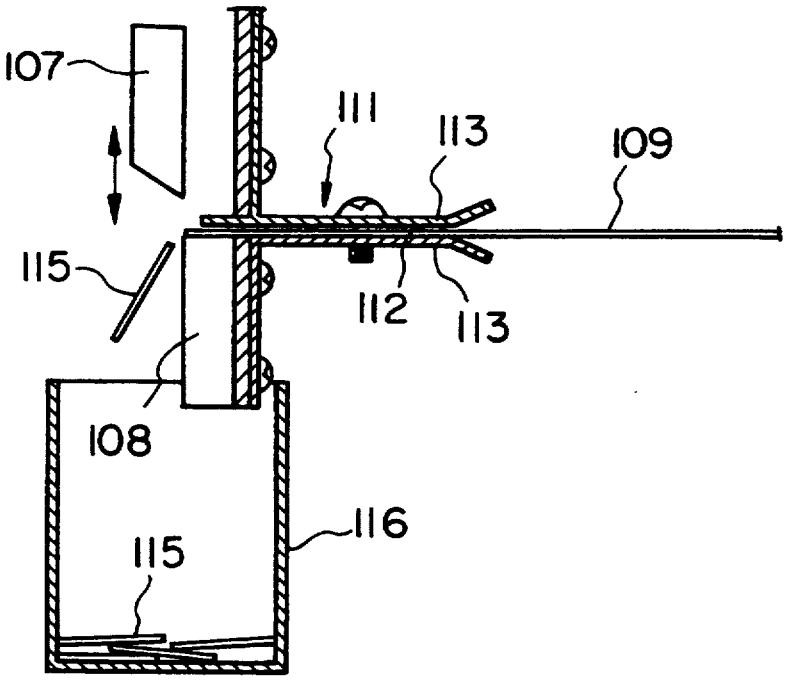
FIG. 6*b* is a sectional view of the card cutting machine in a condition in which the margin in the clearance is being dropped by pushing it by a subsequent sheet.

The margin 115 held in the clearance 112 is pushed out by the sheet subsequently conveyed and is dropped satisfactorily into a chip box 116 without scattering, as shown in FIG. 6*b*.

The sheet 109 passed through the clearance 112 is cut into a card size by the upper and lower blades 107 and 108 of the cutting unit 106, and the cut card is passed through rollers 117 and received into a card receiving box 118.

Although the embodiments of the present invention have been described in detail, it will be understood that the present invention is not limited to these embodiments, and various modifications and variations can be made without departing from the spirit and scope of the invention defined in claims.

What is claimed is:

1. A card cutting machine comprising a feeder and a cutting unit, so that a sheet comprised of a plurality of cards, with a mark affixed to an end thereof, is conveyed from said feeder to said cutting unit, wherein said machine further includes:

a mark reading device mounted in a sheet passage between said feeder and said cutting unit for detecting said mark affixed on the sheet, whereby only desired sheets are passed through said cutting unit, and a margin of each of the sheets is cut off;

a gage sensor mounted in a passage for the sheet conveyed through said cutting unit for successively detecting a leading end of each of said cards to deliver a signal indicative of a command to actuate said cutting unit, and, a stopper mounted in a passage for the sheet conveyed through said gage sensor for temporarily stopping the conveying of said sheet in order to cut the sheet into said card size, said feeder having means for successively feeding the sheet forwardly, thereby separating the cards one by one.

2. A card cutting machine according to claim 1, wherein said mark reading device is a sensor.

3. A card cutting machine according to claim 1, further including a sheet holder in the vicinity of a sheet inlet port in said cutting unit, said sheet holder being comprised of a pair of upper and lower attachments disposed to guide the sheet conveyed into said cutting unit from its opposite sides and to leave a clearance slightly wider than the width of the sheet.

4. A card cutting machine into which sheets defining a plurality of cards are input, said machine cutting the sheets into separate cards, the sheets having a mark affixed near a forward end thereof indicative of whether the sheet is suitable to be cut, said machine comprising:

a feeder;

a cutting unit, said feeder feeding sheets to said cutting unit and said cutting unit cutting the sheets into separate cards;

a mark reading device mounted in a sheet passage between said feeder and said cutting unit, said mark reading device reading the mark affixed to the sheet and determining if the sheet is suitable to be cut, the sheet being fed to the cutting unit only if it is determined to be suitable, the cutting unit cutting off the forward end of suitable sheets behind the mark;

a gage sensor mounted forward of said cutting unit and detecting the forward end of the sheet passed through said cutting unit, said gage sensor delivering a signal to actuate said cutting unit to cut said sheet into a separate card having a predetermined size, said cutting unit activated after a predetermined time has elapsed from detection of the forward end of the sheet; and a stopper mounted forward of said gage sensor and temporarily closed and abutted against by the forward end of the sheet to thereby temporarily stop forward movement of the sheet while the sheet is cut by said cutting unit, wherein, said feeder having means for successively feeding the sheet forwardly to said gage sensor to thereby successively actuate said cutting unit to cut the sheet into a plurality of separate cards.

* * * * *